US007225497B1

(12) United States Patent
Ho

(10) Patent No.: US 7,225,497 B1
(45) Date of Patent: Jun. 5, 2007

(54) MOP DEVICE

(76) Inventor: Te-Chin Ho, No. 144, Yingming Road, Lingya District, Kaohsiung (TW) 802

( * ) Notice: Subject to any disclaimer, the term of this patent is extended or adjusted under 35 U.S.C. 154(b) by 0 days.

(21) Appl. No.: 11/401,632

(22) Filed: Apr. 11, 2006

(51) Int. Cl.
*A47L 13/14* (2006.01)
*A47L 13/144* (2006.01)
*A47L 13/146* (2006.01)

(52) U.S. Cl. ..... 15/119.2; 15/119.1

(58) Field of Classification Search ..... 15/116.1, 15/116.2, 119.1, 119.2, 115
See application file for complete search history.

(56) References Cited

U.S. PATENT DOCUMENTS 5,138,736 A * 8/1992 Pesa ..... 15/119.2
5,528,791 A * 6/1996 Wilson ..... 15/119.2
2006/0236481 A1* 10/2006 Lin ..... 15/119.2

* cited by examiner

*Primary Examiner*—Gary K. Graham

(57) ABSTRACT

A mop device includes a handle member, a pulling grip, a connecting rod, a press assembly, a flat base and a guide arm. The handle member is fixedly attached to a joint head and the joint head has a fork free end with a traverse threaded hole. The pulling grip is pivotally joined to the handle member. The connecting rod is disposed in the handle member and able to move reciprocally while the pulling grip being pulled downward and upward. The press assembly includes two parallel semicircular press plates, two press posts for locating the press plates, and a stop block disposed between the press plates for locating the press plates and performing circular movement along the circular groove. The flat base is composed of two flat plates with each of the flat plates having a lateral side adjacent to each other. A connecting part is joined to the respective lateral side in a way of pins engaging with holes such that the flat plates are capable of turning to vertical positions with the connecting part and turning back to original horizontal position with a torsion spring. The bottom of the flat base is attached with a cleaning element. Hence, advantages such as angular changes being obtained between the rod member and the flat base, water being squeezed out from the cleaning element automatically and the cleaning element being detached from the flat base conveniently.

2 Claims, 5 Drawing Sheets

FIG 4
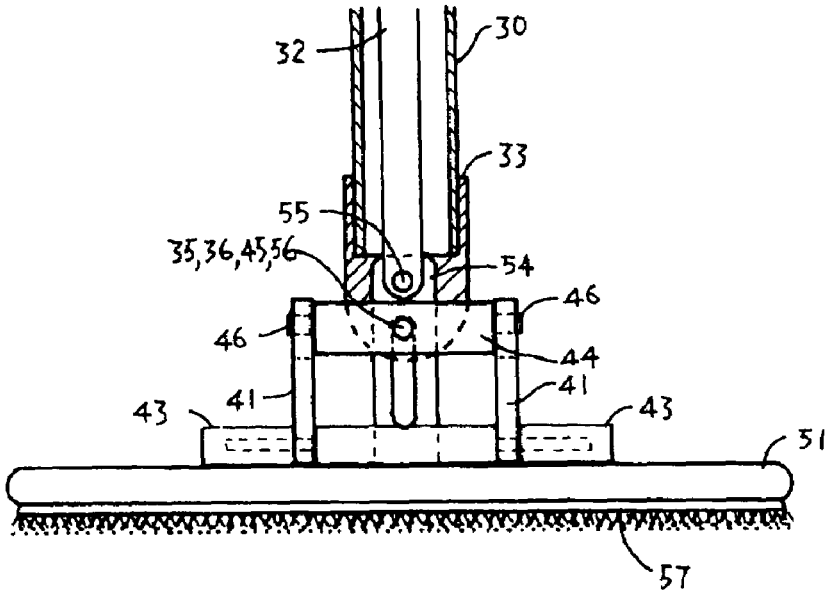
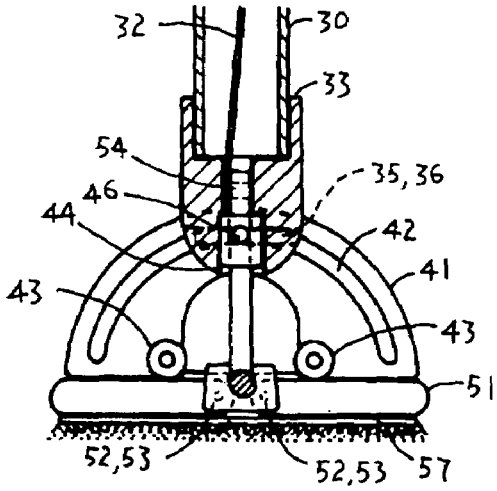
FIG 5

FIG 6
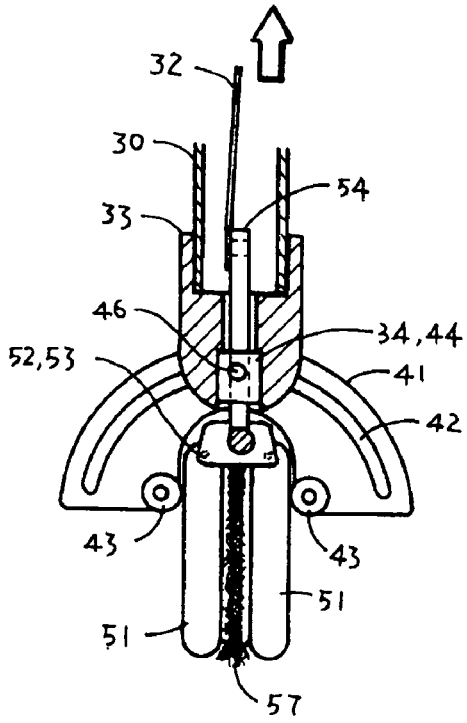
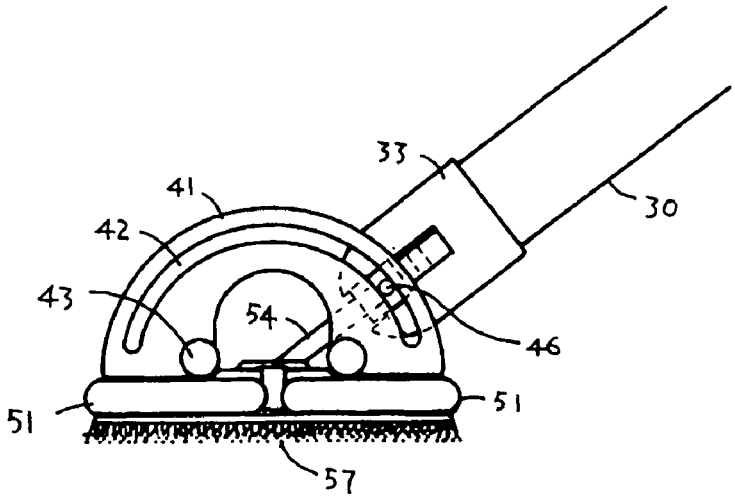
FIG 7

MOP DEVICE

BACKGROUND OF THE INVENTION

1. Field of the Invention

The present invention is mop device and particularly to a mop device with an angularly changeable handle, being capable of squeezing out water automatically and an detachable clean cloth.

2. Brief Description of the Related Art

Referring to FIG. 1, the mop available in the market generally has a handle 10 with a pull grip 11. The front end of the handle 10 provides a water squeeze-out stick set 12. Once the pull grip 11 is pulled upward and downward, a connecting rod 13 in the handle 10 is actuated to move reciprocally. An end of the connecting rod holds a cleaning cotton bar 14 so that the stick set 12 is able to clamp the cleaning cotton bar 14 for squeezing out water inside the cotton bar 14. In practice, the cleaning cotton bar 14 provides a circular outer surface and a line contact is generated between the cleaning cotton bar 14 and the floor so that it offers a limited cleaning effect. Besides, a fixed angular position of the handle 10 related to the cleaning cotton bar 14 makes the conventional mop being unable to clean the floor under lower bottom of the furniture. Further, when the cleaning cotton bar 14 is very dirty, it is not possible for the cleaning cotton bar 14 being detached from the mop in order to clean the cotton bar 14 except carrying the whole mop during cleaning the cotton bar 14. But, in this way, it is hard to clean the dirty cotton bar 14 thoroughly.

Referring to FIG. 2, another type of the conventional mop is illustrated. The type of the conventional mop is simple in structure and a multidirectional joint 21 is attached to the lower end of the handle 20. The multidirectional joint 21 is further joined to a flat plate 22. The bottom of the flat plate 22 is adhered with cleaning cotton cloth. Although the handle 20 can change angular position with respect to the joint 21 for cleaning the floor under the lower bottom of the furniture, water in the cleaning cotton cloth 23 is unable to be squeezed out automatically. In practice, the cleaning cotton cloth 23 has to be detached for being cleaned every time the mop has been used. As a result, the cotton cloth 23 has to be detached and cleaned repeatedly during the mop being operated for cleaning the floor and the hands of the user are easy to be hurt due to immersing in the detergent solution often.

SUMMARY OF THE INVENTION

In order to overcome the preceding disadvantages, an object of the present invention is to provide a mop device which is capable of performing angular change, automatic water squeeze-out and detachable cleaning cloth.

BRIEF DESCRIPTION OF THE DRAWINGS

The detail structure, the applied principle, the function and the effectiveness of the present invention can be more fully understood with reference to the following description and accompanying drawings, in which:

FIG. 4 is a front view of the mop device shown in FIG. 3;

FIG. 5 is a side view of the mop device shown in FIG. 3; and

FIG. 6 is another side view of the mop device similar to FIG. 5 illustrating the mop device being operated to squeeze out water; and FIG. 7 is a further side view of the mop device similar to FIG. 5 illustrating the handle thereof capable of being turned freely.

DETAILED DESCRIPTION OF THE INVENTION

Figure 1:
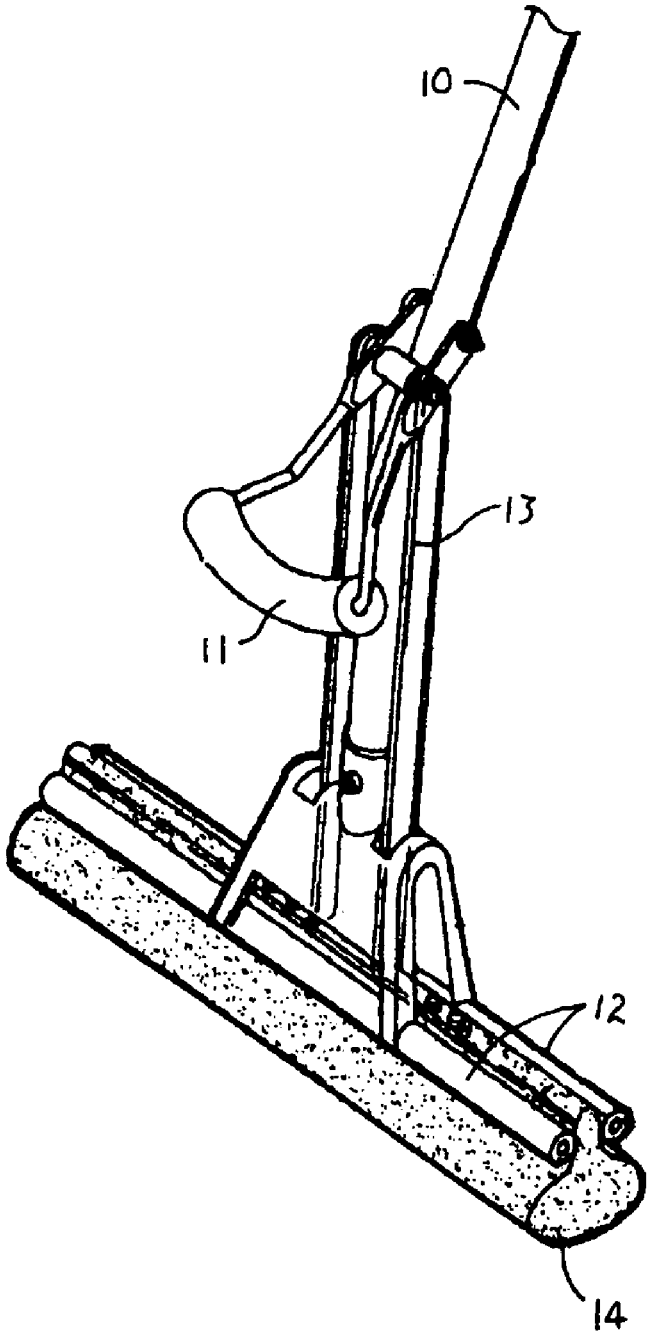
FIG 1 (Prior Art)
FIG. 1 is a perspective view of a type of the conventional mop.
Figure 2:
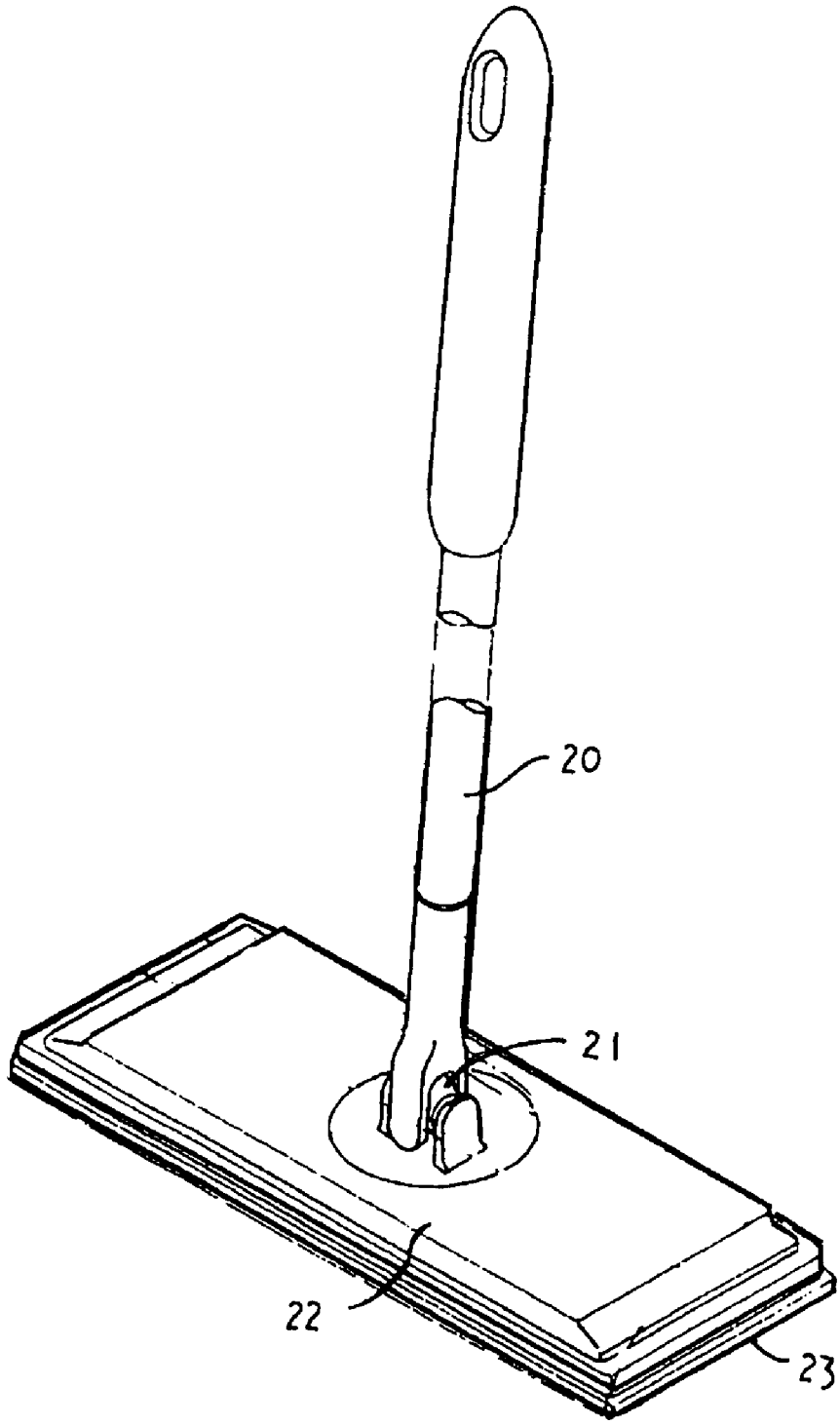
FIG 2 (Prior Art)
FIG. 2 is a perspective view of another type of conventional mop.
Figure 3:
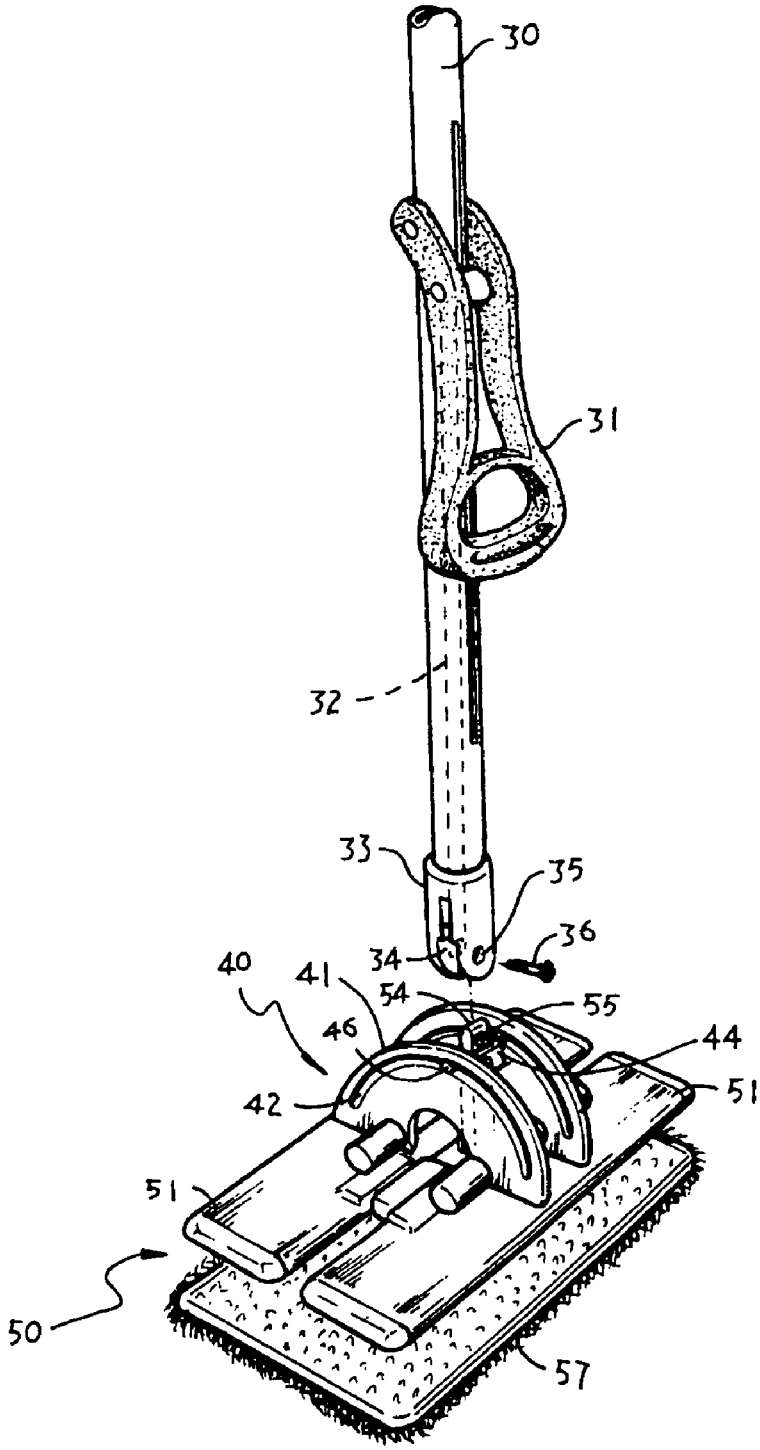
FIG. 3 is a perspective view of a mop device according to the present invention.

Referring to FIGS. 3, 4 and 5, a mop device according to the present invention includes a handle member 30, a press assembly 40 and a flat base 50.

Wherein, the handle member 30 basically is a hollow rod and a pull grip 31 is pivotally attached to the handle member 30. A joint head 33 is fixedly attached to the lower end of the handle member 30. The joint head 33 has a fork shape free end 34 with a transverse threaded hole 35 for being engaged to the press assembly 40 with a bolt 36.

The press assembly 40 provides two semicircular shaped press plates 41 in parallel with a circular groove 42 extending along each of the press plates 41. Two press posts 43 pass through the bottoms of the press plates 41 for locating the press plates 41. A stop block 44 is disposed between the press plates 41 and the width of the stop block 44 is the same as the space between the press plates 41. An engaging hole 45 is provided on the stop block 44 and a guide pin 46 extends outward from two lateral sides of the stop block 44 to movably attach to the circular grooves. In this way, the stop block 44 is capable of locating upper portions of the press plates 41 in place and performs a circular movement along the circular grooves 42.

The flat base 50 is composed of two flat plates 51 and the flat plates 51 join to each other at the adjacent sides thereof with a connecting part, which provides two joining holes 53 for being joined to the flat plates 51 with two pins 52 passing through the joining holes 53 and pivotally attached to the flat plates 51 respectively such that the flat plates 51 can turn down to position vertically oppositely. Further, a torsion spring is provided to keep the flat plates 51 at a horizontally. A guide arm 54 is provided at the central position of the flat base 50. The guide arm 54 has a through hole 55 at the upper end thereof and an elongate groove 56 at the lower end thereof for being able to swing with respect to the lower end thereof on the flat base 50. The bottom of the flat base 50 can be associated with cleaning element 57 such as cotton cloth, sponge, cotton paper or the like by means of adhesive band or any other engaging ways.

The press assembly 40 is placed on top of flat base 50 and the guide arm 54 passes through the stop block 44. The joint heat 33 fits with the guide arm 54 and the stop block 44. The lower end of the guide arm 54 connects with the lower end of the connecting rod 32. The stop block 44 presses against the fork end 34 to allow the bolt 36 passing through the threaded hole 35 and a fitting hole 45 of the stop block 44. Thus, the rod member 30 can be joined to the stop block 44.

Referring to FIG. 6, when the pull grip 31 is operated to pull the handle member 30, the connecting rod 32 is able to move reciprocally and the guide arm 54 is pulled by the connecting rod 32 to move upward. Meanwhile, the stop block 44 stays to press the fork end 34 without moving upward with guide arm 54. Further, the flat plates 51 are pressed with the press posts 43 to move upward with the guide arm 54 to become positioned vertically and opposite to each other such that water in the clean elements 57 can be squeezed out. Once the pull grip 31 is pulled to allow the connecting rod 32 moving back to the original position, the guide arm 54 is actuated to move downward and the flat plates 51 restore to the horizontal positions by means of the torsion spring.

Referring to FIG. 7, when the guide arm 54 swings on the flat base 50 with respect to the lower end thereof, the handle member 30 can swing with the guide arm 54. Hence, the rod member can change the angular position thereof to comply with different heights of the users and to make it easier while cleaning lower gap between furniture and the floor. Because direction of force exerting to the rod member 30 can be changed during operating the mop of the invention, it prevents the flat base 50 from turning over. In addition, it is easy to detach the clean element 57 from the bottom of the flat base 50 conveniently for cleaning or replacing the clean element 57.

It is appreciated that the mop device according to the present invention is capable of changing angular position freely, squeezing out water automatically and being detached from the cleaning cloth easily.

While the invention has been described with referencing to preferred embodiments thereof, it is to be understood that modifications or variations may be easily made without departing from the spirit of this invention, which is defined by the appended claims.

What is claimed is:

1. A mop device, comprising a handle member, being a hollow rod, an end thereof being fixedly attached with a joint head, and the joint head having a fork free end with a traverse threaded hole;

a pulling grip, being pivotally joined to the hollow, rod;

a connecting rod, being disposed in the hollow, rod and able to move reciprocally while the pulling grip is pulled downward and upward;

a press assembly, comprising two parallel semicircular press plates with a circular groove extending along the circular edge of the respective semicircular press plate, two press posts, being disposed at the bottom edges of the press plates for locating the press plates, and a stop block, being disposed between the press plates, having a width the same as a space between the press plates, having a hole, and having two guide pins extending outward from two lateral sides thereof to pass through the circular groove respectively for locating the press plates and performing circular movement along the circular groove;

a flat base, being composed of two flat plates, each of the flat plates having a lateral side adjacent to each other, a connecting part being joined to the respective lateral side by way of pins engaging with holes such that the flat plates are capable of turning to vertical positions with the connecting part and turning back to original horizontal position with a torsion spring, and the bottom thereof being attached with a cleaning element; and a guide arm, being disposed at the center of the flat base to swing on the flat base with respect to a lower end thereof, providing a through hole at an upper end thereof and an elongate groove at the lower end thereof to swing on the flat base with respect to the lower end thereof.

2. The mop device as defined in claim 1, wherein the cleaning element is cotton cloth, sponge or cotton paper.

* * * * *